US005759624A

United States Patent [19]

Neale et al.

[11] Patent Number: 5,759,624

[45] Date of Patent: Jun. 2, 1998

[54] METHOD OF MAKING SYNTACTIC INSULATED CONTAINERS

[75] Inventors: Douglas L. Neale, Allendale, N.J.; Richard J. Pasin, Wilmington, N.C.

[73] Assignee: Insulation Dimension Corporation, Leland, N.C.

[21] Appl. No.: 661,331

[22] Filed: Jun. 14, 1996

[51] Int. Cl.[6] ..... B05D 1/38; B05D 3/02

[52] U.S. Cl. ..... 427/261; 427/288; 427/373; 427/439; 220/454; 220/DIG. 9; 493/110; 493/148

[58] Field of Search ..... 427/244, 261, 427/265, 288, 421, 439, 373; 215/13.1, 12.2; 220/DIG. 9, 454; 493/56, 110, 148; 101/29, 492

[56] References Cited

U.S. PATENT DOCUMENTS

| | | | |
|---|---|---|---|
| 3,357,322 | 12/1967 | Gill | 493/110 |
| 3,785,254 | 1/1974 | Mann | 493/110 |
| 4,051,277 | 9/1977 | Wilkinson et al. | 427/288 |
| 4,241,125 | 12/1980 | Canning et al. | 428/158 |
| 4,617,223 | 10/1986 | Hiscock et al. | 428/211 |
| 4,898,752 | 2/1990 | Cavagna et al. | 427/265 |
| 4,902,722 | 2/1990 | Melber | 521/54 |
| 5,145,107 | 9/1992 | Silver et al. | 229/1.5 B |
| 5,226,585 | 7/1993 | Varano | 229/1.5 B |
| 5,363,982 | 11/1994 | Sadier | 220/441 |

*Primary Examiner*—Shrive Beck
*Assistant Examiner*—Fred J. Parker
*Attorney, Agent, or Firm*—Crummy, Del Deo, Dolan, Griffinger & Vecchione

[57] ABSTRACT

A method of insulating a substrate or a portion thereof by depositing a syntactic foam by a spraying, dipping or a variety of printing processes. The foam comprises void containing particles in expanded form, unexpanded form, or a mixture of these. The deposited foam is dried to remove solvents and cured to strengthen the binder which restrains the microspheres. Heating may also expand the unexpanded microspheres. A tie coat may be applied to promote adhesion between the substrate and the insulating syntactic foam. Multiple layers of the syntactic foam may be applied to increase the thickness of the resultant layer for providing a controlled amount of increased insulation.

31 Claims, 3 Drawing Sheets

METHOD OF MAKING SYNTACTIC INSULATED CONTAINERS

BACKGROUND OF THE INVENTION

CROSS REFERENCE TO RELATED APPLICATION

This application is related to another U.S. patent application, having a filing date of Jun. 14, 1996, and Ser. No. 08/661,332 entitled "SYNTACTIC FOAM INSULATED CONTAINER", having common inventors and assignee and being incorporated herein by reference.

FIELD OF THE INVENTION

This invention relates to insulating a substrate with a syntactic foam, and more particularly to controlling the effectiveness of the insulation by controlling the composition and thickness of the foam in a deposition process. A typical application of this method is the making of insulated cups and containers.

DESCRIPTION OF RELATED ART

The production and use of disposable containers, such as cups, is well known with production measured in the billions of units annually. Because of this volume, the business is fiercely competitive and cost is measured in units of one thousand. A change of a few percent in cost can make a container unsaleable, particularly to large fast food chains.

Paper and paperboard are widely used as materials in the production of disposable containers because they are inexpensive and amenable to very high volume production. They have limitations, however, particularly in containing hot liquids which are dispensed from coffee machines or supplied in fast food restaurants. The initial temperature of coffee poured into a disposable cup can approximate 200 degrees Fahrenheit, and the temperature achieved on the outside of the cup can make it painful to hold. A person's reaction to this pain can cause spillage, severe damage to the skin, and inevitable product liability litigation.

Consequently there have been many attempts to provide improved insulation to paper containers. U.S. Pat. No. 5,363,982 to Sadlier shows a cup formed from one continuous sheet where the outer and inner shells are spaced apart by a corrugated layer which forms many air pockets between the shells to insulate the cup and provide greater strength. The blank from which the cup is formed is at least three times as long as that for a conventional cup, thereby adding to the cost.

U.S. Pat. No. 5,226,585 to Varano discloses a double wall structure in which inwardly directed ribs from the outer surface maintain a gap between the walls to provide insulation. Again added material means added cost.

U.S. Pat. No. 5,145,107 to Silver et al. teaches a double wall structure wherein the inner wall is connected to the outer one only at the lip and at the base of the cup. The walls have different tapers thereby defining a dead air space between them which provides insulation.

Accordingly, there still exists a need for making an inexpensive material for a container which provides a controlled amount of heat transfer to warn the user that a hot liquid is contained therein, and which insulates sufficiently to protect against pain or burn. The method must also be compatible with high volume container making machinery.

SUMMARY OF THE INVENTION

The present invention relates to making a substrate with a controlled amount of insulation and incorporating that substrate into the manufacture of containers for hot or cold food products and liquids. The method needs to be inexpensive, so a layer of insulation is applied to one side of a substrate used to make a container, which is typically paper or paperboard to control cost, but the insulation could be applied to a single-walled plastic cup as well. The insulation is a syntactic foam, that is, a foam which incorporates insulating particles which are held in place by a binder. Greater insulation is obtained where the insulating particles are void containing particles which can be made from thermoplastic, thermoset, or inorganic materials which enclose an air space. The void containing particles may be of arbitrary shape and they may be applied to the substrate in expanded or unexpanded form. A subsequent heating operation may be used to expand previously unexpanded particles so that they contain voids. There are many different types of void containing particles and they may be used alone or in combination with each other to achieve a particular degree of insulation or other mechanical properties. These void containing particles are held in place by a binder, into which other ingredients may also be added to produce a color (pigment), to control viscosity (thickeners and solvents), and to control density (fillers and foaming agents).

In one embodiment of the invention the foam is applied by depositing a first layer onto the substrate, drying it to remove any solvents which may be needed to control printing parameters, and curing a binder which keeps the void containing particles in place. This is often done by the application of heat which will also cause unexpanded void containing particles to expand. Some binders may be cured by radiation. A tie coat may be applied to the substrate to promote adhesion of the syntactic foam. The foam provides a controlled degree of insulation by adjusting its thickness, particle type, and composition, so that a user has enough sensation to know that a hot or cold liquid is inside the container, yet not enough sensation to cause discomfort. These containers may be used for all types of foods and liquids, such as soups, frozen foods that are reheated, ice cream, and so on.

In another embodiment of the invention, a layer of syntactic foam is deposited on a first surface of a substrate, the foam is dried, cured, and another layer is deposited over the syntactic foam for the functional purpose of: impeding moisture, resisting abrasion, improving appearance, promoting adhesion, or adding thermal insulation. A tie coat may be applied to the first surface to promote adhesion. A functional material may be applied to the second surface of the substrate to provide a moisture, vapor, or gas barrier.

In yet another embodiment of the invention, making a container comprises coating a first side of a substrate with a layer of a thermoplastic, printing a first layer of a syntactic foam upon a second side of the substrate, drying the syntactic foam to remove any solvents present, heating it to cure a binder which restrains the void containing particles contained therein, die cutting the substrate supporting the thermoplastic layer and the syntactic foam in the form of a blank, forming the blank to make a preform of a container, and heating the preform to seal the thermoplastic layer to selected areas of the preform, thereby creating the container. Not all containers are heat sealed. Some are locked together or they may be glued together like a clamshell. The adhesives may range from heat seals, hot melts, pressure sensitive, and cold set types which are well known in the art of making containers.

The insulating layer may be applied in various configurations. The foam may be applied in a continuous layer on the substrate or container, or the syntactic foam may nearly cover the blank from which the cup is made except for edge areas which are designated for sealing the sidewall to itself and the bottom of the cup and the formation of the rolled rim at the top of the cup. The syntactic foam may be applied as a pattern of matrix elements, which may be dots, lines, quadrangles, arcs, letters, symbols, or any other fanciful configuration. The interrupted pattern saves material, yet still keeps fingers away from the sidewall of a cup because the air spaces between the pattern elements are limited so that fingers can not descend between the elements to touch the sidewall.

A tie coat may be interspersed between the insulating pattern elements and the substrate to promote adhesion. It may be continuous over most of the blank and pattern elements are printed thereon or it may also be patterned.

A second layer may be applied over the syntactic foam for a functional purpose of: impeding moisture penetration, resisting abrasion, enhancing appearance, promoting adhesion, or adding insulation.

Multilayer applications are contemplated for all the embodiments, and a combination foam employing void containing particles together with a foaming agent may produce a spongy coating which also contains void containing particles.

The void containing particles may be in expanded form or unexpanded form, or in a combination of both forms as applied. For unexpanded microspheres a heating step expands them.

These and other features and advantages of the invention will be better understood with consideration of the following detailed description of the preferred embodiments.

DETAILED DESCRIPTION OF THE PREFERRED EMBODIMENTS

Figure 1A:
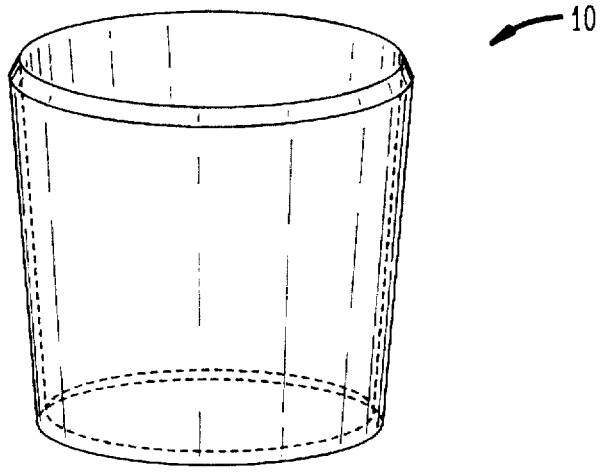
FIG. 1A and 1B show an exemplary container (A) and container blank (B) produced in accordance with the present invention method.

The use of disposable containers reaches billions of units per year in the home and in the fast food industry. These containers are most often in the form of drinking cups which are made from paper, paperboard, or plastic, and to be competitive in the marketplace they must be very inexpensive. Paper is an inexpensive material, and it is also well adapted to high volume production.

However, paper or paperboard is not a sufficient thermal insulator when used for the sidewalls of a container which stores hot liquids. For example, coffee can be made and dispensed at temperatures near 200 degrees Fahrenheit. A common experience is lifting a paper container from a coffee dispensing machine and burning the fingers on the sidewall of the container.

A variety of configurations have been proposed to improve the insulation properties of the sidewall of paper containers by using double walled sidewalls which trap air and reduce heat transfer. These approaches can add a factor of three times the material cost or complicate the rolling and sealing operation.

The present invention uses a single layer wall with an added layer of insulation on the external side of the sidewall. The layer may be printed on the outside wall in a single coat, or in multiple coats, in a continuous pattern or in a matrix pattern of lines, dots, or any other fanciful pattern. High volume printing, in moderately thick layers as used in the present invention, is well known in the graphic arts industry.

U.S. Pat. No. 4,902,722 given to Melber describes the use of syntactic foam graphic arts print media. Syntactic foams have cells which are preformed by way of incorporating small hollow particles into them, rather than by making the foam by the expansion of a blowing agent. The particles are called microspheres or microballons by various inventors and they have particle sizes ranging from approximately 10 to 100 microns in the graphic arts industry, and even larger when they are used in the molded parts industry.

U.S. Pat. No. 5,120,769 given to Dyksterhouse, et al. teaches the preparation of syntactic foams and suitable powder compositions. This is an excellent tutorial describing the geometry of microspheres, the surrounding polymer binder, and the use of solvents, surfactants, thickeners, and fillers. The materials disclosed in this patent are incorporated herein by reference.

U.S. Pat. No. 5,385,778 given to Deviney et al. shows the use of microspheres to improve the mechanical toughness of plastic molded parts. The microspheres interrupt the propagation of cracks in high performance plastic structures. In this case the particle size of the microspheres ranges from 0.1 to 50 microns.

U.S. Pat. No. 5,244,613 given to Hurley et al. describes the production of reinforced moldings formed in a reaction injection molding operation. The addition of microspheres improves the mechanical properties by reducing density, lowering volume costs, improving impact resistance, and reducing shrinkage. The reaction injection molding process has become important in the production of external automotive body parts.

The present invention preferably incorporates graphic arts printing processes and the use of void containing particles in syntactic foams to control thermal properties, rather than the mechanical properties described above. However, the foam could also be applied by spraying or dipping.

Figure 1B:
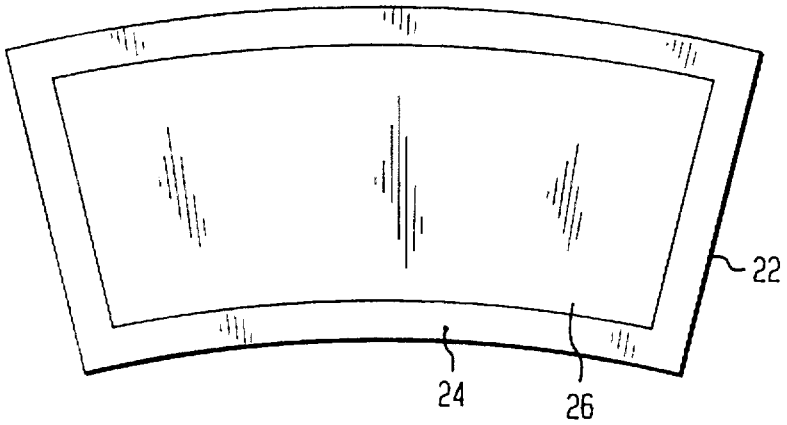

Referring to FIG. 1A there is shown a one exemplary embodiment of a container 10 made in accordance with the present invention method. The container 10 is typically made from a blank 20, shown in FIG. 1B, which is cut from a substrate 22 which may be plastic but more typically is paper or paper board, and preferably solid bleached sulfate ranging in thickness from 10 mils to 26 mils. The substrate is coated one side with an inner coating, which is typically a thermoplastic, and preferably polyethylene whose thickness ranges from 0.5 mils to 2.0 mils. The coating of paper with polyethylene is well known and substrate stock of this type is available commercially from several sources. The most common purposes of the inner coating are to seal the paper or paperboard to make it impervious to liquids, vapors, aromas, and gases; and to seal the container at its seams and at the intersection of the sidewall with the base. The impervious inner layer ensures the freshness of the product contained and it also prevents the penetration of gases such as carbon dioxide for frozen food containers. This method of construction is given by way of example because the method of construction may vary with the type of container. Not all containers are heat sealed. Some are locked together or they may be glued together like a clamshell. The adhesives may range from heat seals, hot melts, pressure sensitive, and cold set types which are well known in the art of making containers. Machines which seal the base and sidewall are well known and are adapted to high volume production. The outer surface 24 of the sidewall supports an insulating syntactic foam coating 26, which does not cover the entirety of the blank 22, but which leaves a frame uncoated so that the inner coating can seal the sidewall.

Figure 2:
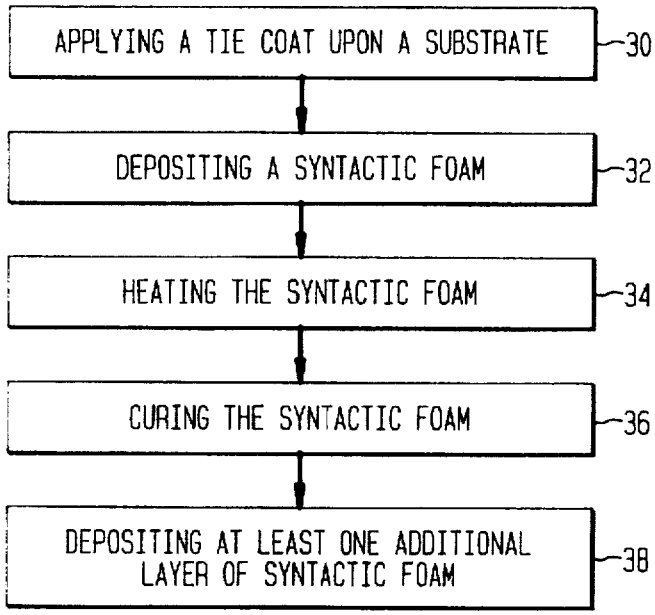
FIG. 2 shows the steps in practicing one embodiment of the invention.

In one embodiment of the invention, outlined in FIG. 2, a substrate material such as plastic, paper, or paperboard is prepared by applying a tie coat to it in a first step 30, depositing a syntactic foam over the tie coat in next step 32, heating the syntactic foam to remove any solvents which might be needed to adjust printing parameters in a further step 34, and curing the syntactic foam by heating it, or by applying radiation for a radiation cured system in another step 36. Depositing a second layer, or multiple layers, of syntactic foam over the first layer in a next step 38 provides a controlled amount of increased insulation. The syntactic foam may also contain a foaming agent, and the step of heating the syntactic foam 34 will increase its volume and lower its density providing for a softer feel and a changed thermal conductivity. These steps are well adapted to coating paper or paperboard meant for the making of containers.

The syntactic foam coating may be deposited by any process such as spraying or withdrawing the substrate from a bath. The deposition may also be by any printing process such as offset, gravure, flexographic, rotary screen, wire rod, air knife, spray, and others. Preferably the printing is done through a rotary metal screen. Rotary screen printing is well adapted to high volume production, typical machines being furnished by Stork Brabant, Charlotte, N.C. A coating of 10 to 30 mils in thickness may be achieved in a single pass and thicker coatings are possible with multiple applications. The function of the syntactic foam coating is to provide a controlled amount of insulation. By controlling the composition and thickness of the coating sufficient thermal protection to the user is achieved while minimizing the material cost of the container. The function of the outer coating is to provide a controlled amount of insulation so that the user can hold the container comfortably, yet know that a hot or cold liquid is contained inside. The outer coating contains void containing particles which can be made from thermoplastic, thermoset, or inorganic materials. A void containing particle comprises an outer shell of arbitrary shape which surrounds any medium of lower thermal conductivity or lower density. The void containing particle may be in expanded or unexpanded form. An unexpanded void containing particle will expand with the application of heat which expands the encapsulated medium and also softens the surrounding outer shell until the pressure of the medium is balanced by restraining forces in the outer shell. The void containing particles may range from 0.1 microns to 200 microns in size in either form. Typical examples of the materials of the outer shell would be polyvinylidene copolymers or glass. The largest particle size in the application process being limited by the openings in the metal mesh of the printing machine. If unexpanded microspheres are applied to the blank, a subsequent heating process may be employed to expand them. This might be coupled with the sealing operation. Experiments have also shown that multiple applications of unexpanded microspheres, separated by an expansion step provide better insulation than a single application of the same thickness. The binder holding the microspheres may be any suitable synthetic or natural binder including aqueous based, solvent based, high solids, or 100% solids materials, such as radiation cured systems, which are mentioned in the references. Additional ingredients may be added to the formulation, such as: pigments or dyes for coloring, fillers/extenders of organic or inorganic materials, surfactants for dispersion or rheology, thickeners and solvents to control viscosity for optimized application, foaming agents to control the density of the coating, additives like waxes or slip aids, and plasticizers and other ingredients common to the formulation of coatings. In a preferred embodiment, the resin is acrylic, the void containing particles are synthetic microspheres whose particle size distribution ranges from 10 to 20 microns, and whose weight fraction in the wet mix ranges from 1 to 20 percent. The microspheres are available from Akzo Nobel, Duluth, Ga. Other additions may include: inorganic silica beads which are available as "Sil-cell" brand from Silbrico Corporation, Hodgkins, Ill., or coated microspheres which are available as "Dualite" brand from Pierce and Stevens, a division of Pratt and Lambert, Buffalo, N.Y.

The printed syntactic foam may be in the form of a pattern comprising a matrix of elements such as dots, lines, quadrangles, arcs, alphabetical letters symbols, or the like. The common properties among them being that (1) the interrupted pattern saves material, and (2) the pattern elements are sufficiently close together to prevent fingers from descending between the pattern elements to touch the sidewall. The insulation properties of the pattern are therefore controlled by the thickness and composition of the material comprising the pattern, together with the ratio of the area of the elements of the pattern to the area of the substrate. Area ratios may range from 10 to 100 per cent. The lower end of the coverage ratio being controlled by the maximum distance between pattern elements which will support a finger away from the substrate.

Figure 3:
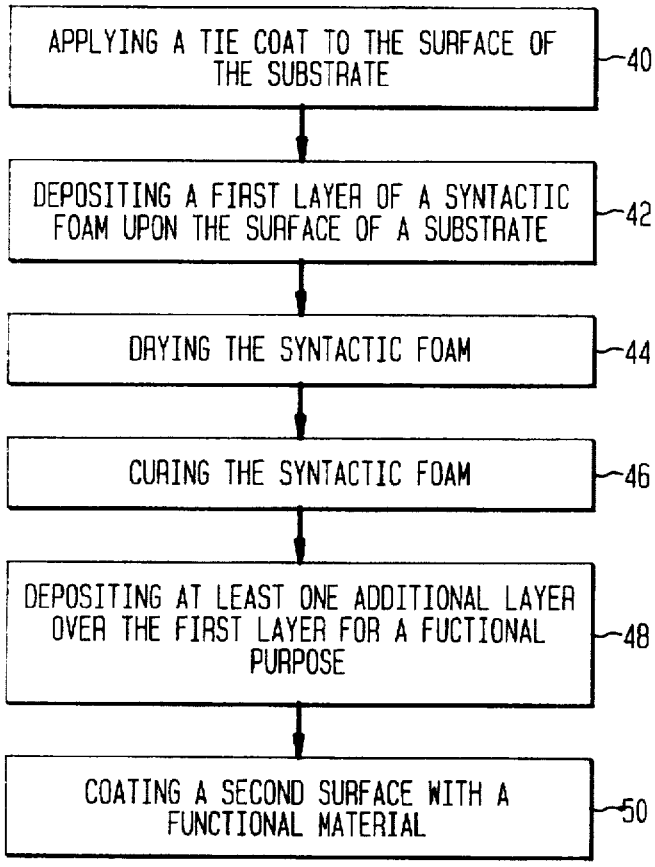
FIG. 3 shows the steps in practicing another embodiment of the invention.

In another embodiment of the invention, outlined in FIG. 3, a tie coat may be interspersed between the substrate and the syntactic foam (40). A syntactic foam insulating coating is applied to a first surface of a substrate (42), dried to remove any solvents which remain (44), and cured to strengthen the foam (46). At least one additional layer may be applied over the syntactic foam for a functional purpose (48) which may be to: impede moisture penetration, provide added thermal insulation, resist abrasion, improve appearance, or promote adhesion. A second surface may be coated with a functional material (50).

Figure 4:
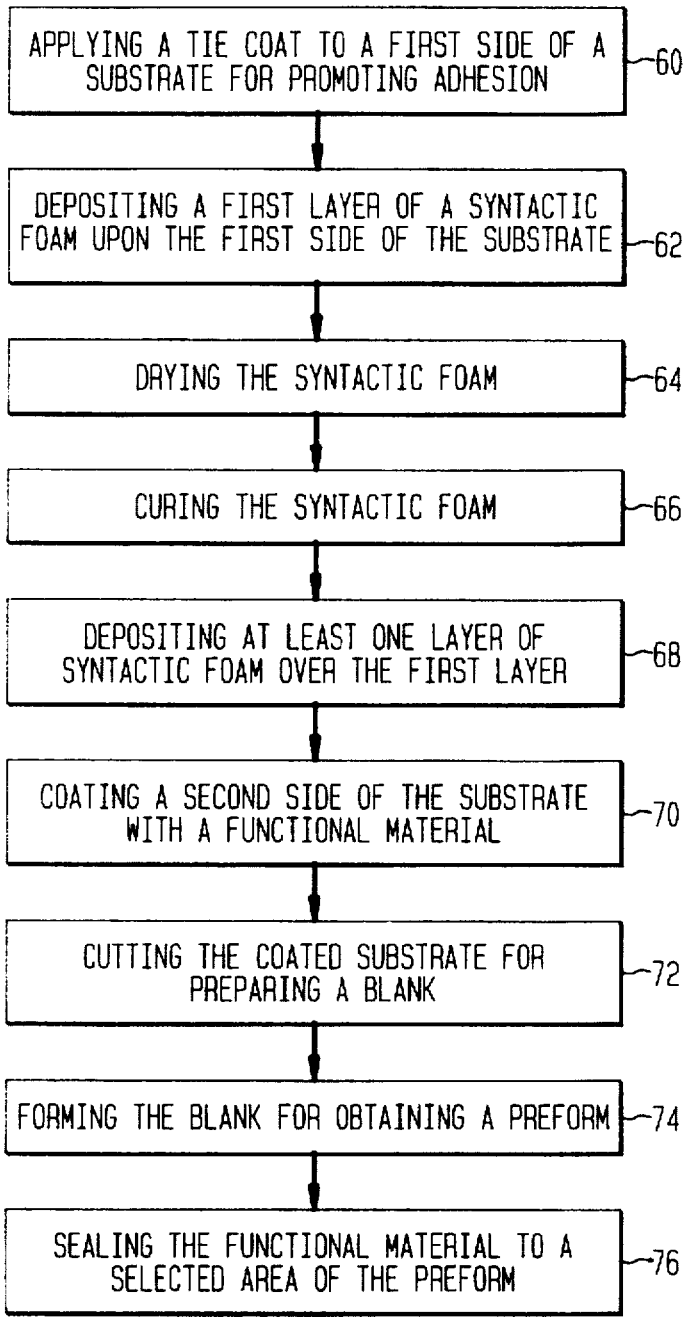
FIG. 4 shows the steps in practicing yet another embodiment of the invention.

In yet another embodiment of the invention, outlined in FIG. 4, a syntactic foam insulated container is made by applying a tie coat to a first side of a substrate to promote adhesion between the substrate and a subsequent layer of syntactic foam (60), depositing a first layer of a syntactic foam upon a first side of the substrate to create an insulating layer (62), drying the syntactic foam to remove any solvents (64), curing the syntactic foam by heating it or by irradiating it to keep the void containing particles fixed (66), depositing at least one layer of syntactic foam over the first layer to provide a controlled degree of insulation (68), coating a second side of the substrate with a layer of a functional material to create a sealing layer (70), cutting the substrate supporting the functional material layer and the syntactic foam to prepare a blank (72) which is adapted to make the container, forming the blank for obtaining a preform of a container (74), and sealing the functional material to selected areas of the preform (76). The syntactic foam may contain void containing particles ranging from 0.1 microns to 200 microns in particle size, a binder, a pigment, or a foaming agent, used singly or in combination. Typical temperatures for expanding the unexpanded void containing particles range from 150 to 400 degrees Fahrenheit. The binder can cure under similar conditions depending on its composition. Ideally, both are accomplished in one step (66).

The printing may provide a first layer of syntactic foam which is continuous over a major part of the substrate, leaving enough of a border for sealing purposes, or the first layer of syntactic foam may be a pattern comprising pattern elements.

The syntactic foam may have void containing particles in expanded or unexpanded form, used singly or in combination.

Printing a second layer of unexpanded microspheres with a rotary screen printer over the first layer will increase the insulation. Multiple layers could achieve 120 mils or more in thickness. Each layer may be expanded in an intervening step, or a few layers may be expanded in one step.

Changes and modifications in the specifically described embodiments can be carried out without departing from the scope of the invention. In particular, in any of the embodiments above, multilayers comprised of previously expanded void containing particles are also within the scope of the invention. A coating containing microspheres plus a foaming agent could provide a spongy coating. Various combinations of underlayers and patterns are also within the scope of the invention.

We claim:

1. A method of making a syntactic foam insulated container comprising:

depositing a first layer of a syntactic foam at a controlled thickness upon a first surface of a substrate for creating an insulating layer providing a controlled amount of insulation;

curing the syntactic foam for strengthening it;

cutting the substrate with the cured syntactic foam layer thereon for preparing a blank; and forming the blank into a preform of the container.

2. The method of claim 1 wherein the depositing is performed by printing.

3. The method of claim 2 wherein the printing is performed by a rotary screen printer.

4. The method of claim 1 wherein the depositing is performed by spraying.

5. The method of claim 1 wherein the depositing is performed by withdrawing the substrate from a container holding the syntactic foam.

6. The method of claim 1 wherein the curing is performed by heating the syntactic foam.

7. The method of claim 1 wherein the curing is performed by irradiating the syntactic foam.

8. The method of claim 1 further comprising drying the syntactic foam, before curing, for removing solvents.

9. The method of claim 1 further comprising coating a second surface of the substrate with a thermoplastic and heating the thermoplastic for sealing the preform at selected areas of the first and second surface to form a seam.

10. The method of claim 1 further comprising coating a second surface of the substrate with a pressure sensitive adhesive and bonding selected areas of the first and second surface to seal the preform to form a seam.

11. The method of claim 1 further comprising coating a second surface of the substrate with a cold set adhesive and pressure bonding selected areas of the first and second surface to seal the preform to form a seam.

12. The method of claim 1 wherein the forming step comprises forming the blank into a clamshell-shaped preform, and further comprising the step of joining together the clamshell-shaped preform at selected areas of the first and second surface to enclose a volume therein.

13. The method of claim 1 wherein the syntactic foam comprises void-containing particles whose particle size ranges from 0.1 microns to 200 microns.

14. The method of claim 1 wherein the syntactic foam comprises unexpanded void-containing particles whose particle size ranges from 0.1 microns to 200 microns.

15. The method of claim 14 further comprising heating the unexpanded syntactic foam for expanding the void-containing particles.

16. The method of claim 1 wherein the syntactic foam comprises a mixture of expanded and unexpanded void-containing particles.

17. The method of claim 1 further comprising coating a second surface of the substrate with a moisture barrier material.

18. The method of claim 1 further comprising coating a second surface of the substrate with a vapor barrier which is impenetrable to aromas.

19. The method of claim 1 further comprising coating a second surface of the substrate with a gas barrier.

20. The method of claim 19 wherein the gas barrier is impenetrable to carbon dioxide.

21. The method of claim 1 further comprising applying a tie coat to the substrate for promoting adhesion between the substrate and a subsequent layer of syntactic foam.

22. The method of claim 1 wherein the first layer of syntactic foam comprises a continuous layer over a major part of the first surface of the substrate.

23. The method of claim 1 wherein the substrate is paper.

24. The method of claim 1 wherein the substrate is paperboard.

25. The method as recited in claim 1 wherein the controlled thickness is sufficiently thin to provide a thermal sensation and sufficiently thick as to not cause discomfort from the thermal sensation.

26. The method as recited in claim 1 wherein the controlled thickness is selected between 10 mils and 30 mils.

27. A method of making a syntactic foam insulated container comprising:

printing a first layer of a syntactic foam of a controlled thickness upon a first surface of a substrate for creating an insulating layer providing a controlled amount of insulation;

curing the first layer of syntactic foam for strengthening it;

depositing at least one additional layer of a controlled thickness of syntactic foam over the first layer of syntactic foam;

curing the additional layer of syntactic foam for strengthening it;

cutting the substrate with the cured layers of syntactic foam thereon for preparing a blank; and forming the blank into a preform of the container.

28. The method of claim 27 wherein the additional layer of syntactic foam forms an interrupted pattern of closely spaced elements.

29. The method as recited in claim 27 wherein the controlled thickness of the first layer and the controlled thickness of the additional layer combined are sufficiently thin to provide a thermal sensation and sufficiently thick as to not cause discomfort from the thermal sensation.

30. The method as recited in claim 27 wherein the controlled thickness of the first layer and the controlled thickness of the additional layer combined are selected between 10 mils and 30 mils.

31. A method of making a syntactic foam insulated container comprising:

printing a first layer of a syntactic foam of a controlled thickness upon a first surface of a substrate for creating an insulating layer to provide a controlled amount of insulation wherein the first layer of syntactic foam forms an interrupted pattern of closely spaced elements;

curing the syntactic foam for strengthening it;

cutting the substrate with the cured syntactic foam layer thereon for preparing a blank; and forming the blank into a preform of the container.

* * * * *